US008503917B2

(12) United States Patent
Ichizawa

(10) Patent No.: US 8,503,917 B2
(45) Date of Patent: Aug. 6, 2013

(54) ROLLER COMPONENT WITH NON-CONSTANT SIZE OF CELLS AND IMAGE FORMING APPARATUS

(75) Inventor: Nobuyuki Ichizawa, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 331 days.

(21) Appl. No.: 13/019,719

(22) Filed: Feb. 2, 2011

(65) Prior Publication Data

US 2012/0070202 A1 Mar. 22, 2012

(30) Foreign Application Priority Data

Sep. 21, 2010 (JP) ..... 2010-211259

(51) Int. Cl.
*G03G 15/16* (2006.01)

(52) U.S. Cl.
USPC ..... 399/313; 492/18

(58) Field of Classification Search
USPC ..... 399/302, 313, 314; 492/18
See application file for complete search history.

(56) References Cited

U.S. PATENT DOCUMENTS

| | | | | |
|---|---|---|---|---|
| 6,836,636 | B2 * | 12/2004 | Saito | 399/313 |
| 7,039,351 | B2 * | 5/2006 | Tomizawa | 399/313 |
| 7,486,919 | B2 * | 2/2009 | Furuya | 399/313 |

FOREIGN PATENT DOCUMENTS

| | | |
|---|---|---|
| JP | A-10-48916 | 2/1998 |
| JP | A-2000-250343 | 9/2000 |
| JP | A-2001-109232 | 4/2001 |

* cited by examiner

*Primary Examiner* — William J Royer
(74) *Attorney, Agent, or Firm* — Oliff & Berridge, PLC

(57) ABSTRACT

A roller component includes a layer composed of a foamed rubber material including plural cells formed by gas, the layer being formed into a substantially cylindrical body, wherein a volume of the cells decreases from an inner side of the substantially cylindrical body toward the outside.

10 Claims, 7 Drawing Sheets

FIG. 8

| | | HARDNESS (ASKER C) | DENSITY (g/cm³) | BEFORE IMAGE FORMATION | | AFTER IMAGE FORMATION | | |
|---|---|---|---|---|---|---|---|---|
| | | | | VOLUME RESISTANCE | IMAGE QUALITY | VOLUME RESISTANCE | IMAGE QUALITY | |
| | | | | log Ω | FIRST CONDITION | log Ω | FIRST CONDITION | SECOND CONDITION |
| INTERMEDIATE TRANSFER BELT 500 | SECOND TRANSFER ROLLER 700 | 38 | 0.46 | 6.60 | ○ | 6.86 | ○ | ○ |
| INTERMEDIATE TRANSFER BELT 500T | SECOND TRANSFER ROLLER 700 | 38 | 0.46 | 6.60 | ○ | 6.84 | ○ | GENERATION OF SCALE-LIKE PATTERN |
| INTERMEDIATE TRANSFER BELT 500 | SECOND TRANSFER ROLLER 700T | 37 | 0.48 | 6.99 | ○ | 7.85 | GENERATION OF WHITE LINES | ○ |

ROLLER COMPONENT WITH NON-CONSTANT SIZE OF CELLS AND IMAGE FORMING APPARATUS

CROSS-REFERENCE TO RELATED APPLICATIONS

This application is based on and claims priority under 35 USC 119 from Japanese Patent Application No. 2010-211259 filed Sep. 21, 2010.

BACKGROUND

The present invention relates to a roller component and an image forming apparatus.

SUMMARY

According to an aspect of the invention, there is provided a roller component including a layer composed of a foamed rubber material including plural cells formed by gas, the layer being formed into a substantially cylindrical body, in which a volume of the cells decreases from an inner side of the substantially cylindrical body toward an outside.

BRIEF DESCRIPTION OF THE DRAWINGS

Exemplary embodiments of the present invention will be described in detail based on the following figures, wherein:

FIG. 8 is a table showing the results when a volume resistance of a contact layer before and after image formation and an image quality is examined.

DETAILED DESCRIPTION

Exemplary Embodiment

Figure 1:
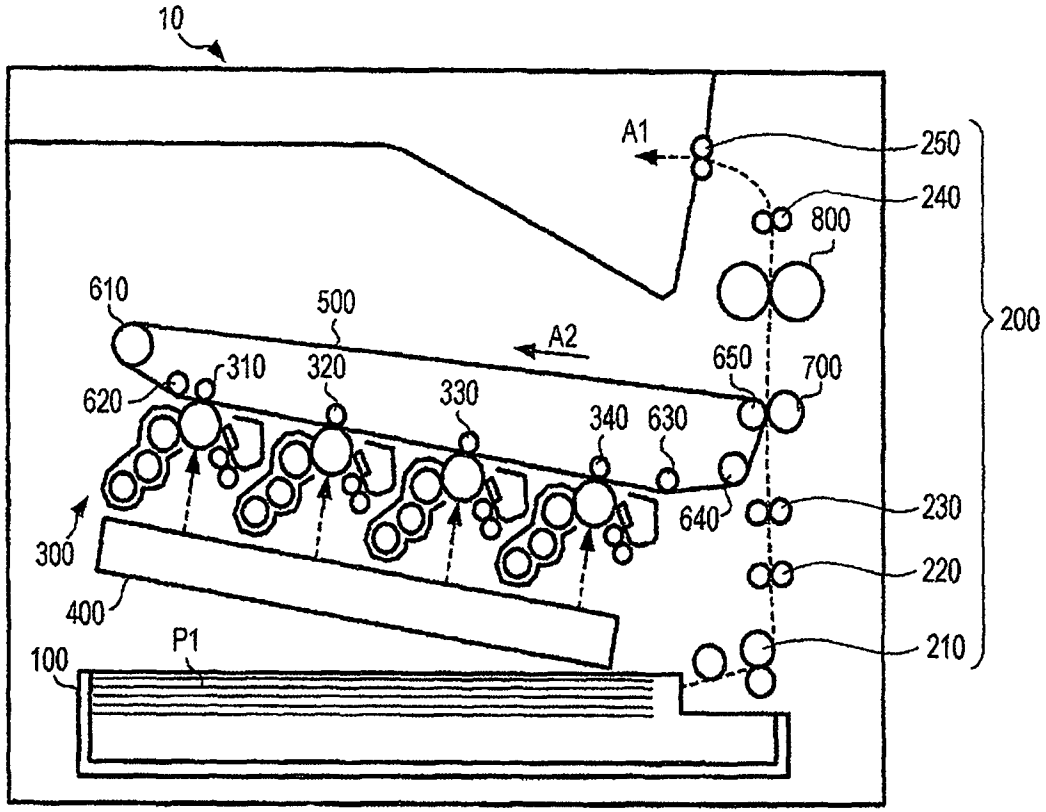
FIG. 1 is a view showing a structure of an image forming apparatus according to an exemplary embodiment of the present invention.

FIG. 1 is a view showing the structure of an image forming apparatus according to an exemplary embodiment of the present invention. An image forming apparatus 10 of this exemplary embodiment is an electrophotographic printer including a sheet supply unit 100, a transport unit 200, a first transfer unit 300, an exposure unit 400, an intermediate transfer belt 500, support rollers 610, 620, 630, 640, and 650, a second transfer roller 700, and a fixing unit 800. The image forming apparatus 10 further includes a controller (not shown) that controls operations of these components.

Plural recording media P1 are placed in the sheet supply unit 100, and the sheet supply unit 100 supplies the recording media P1 one by one. The recording media P1 are, for example, so-called sheets, specifically, sheets that are cut to have a predetermined size in advance. The transport unit 200 includes transport components 210, 220, 230, 240, and 250. These transport components 210, 220, 230, 240, and 250 are, for example, each a cylindrical component and transport the recording media P1 along a path shown by the broken-line arrow A1 in FIG. 1.

The first transfer unit 300 transfers plural toners of different colors (for example, four colors of yellow, magenta, cyan, and black). The first transfer unit 300 is in contact with the intermediate transfer belt 500. The first transfer unit 300 includes, for each color, a roll-shaped photoconductor drum that holds an electrostatic latent image and a toner image, a charger that charges the photoconductor drum, and a developing device that provides the photoconductor drum with a toner, and includes, for respective colors, first transfer rollers 310, 320, 330, and 340 corresponding to the photoconductor drum, the charger, and the developing device. A first transfer bias voltage is applied between each of the first transfer rollers 310, 320, 330, and 340 and the corresponding photoconductor drum. Each of the first transfer rollers 310, 320, 330, and 340 transfers a toner image held on the corresponding photoconductor drum onto the intermediate transfer belt 500 by the action of the generated electric field. The exposure unit 400 irradiates the charged photoconductor drums with light corresponding to the toner images of respective colors, thus forming an electrostatic latent image on each of the photoconductor drums.

The intermediate transfer belt 500 is a strip-shaped component that has no end in the rotational direction. That is, the intermediate transfer belt 500 is an endless component with respect to the rotational direction. By being rotated, the intermediate transfer belt 500 functions as a device that transports the toner images transferred from the respective photoconductor drums by the first transfer unit 300. The intermediate transfer belt 500 corresponds to an example of a "transfer belt" according to an exemplary embodiment of the present invention.

Each of the support rollers 610, 620, 630, 640, and 650 is a cylindrical component that rotates on a rotation axis. Each of the support rollers 610, 620, 630, 640, and 650 supports the intermediate transfer belt 500 at the inside of the intermediate transfer belt 500 so that an appropriate tension is provided to the intermediate transfer belt 500.

The second transfer roller 700 is a cylindrical or substantially cylindrical component that faces the support roller 650 with the intermediate transfer belt 500 therebetween and that forms a nip region with the intermediate transfer belt 500. The second transfer roller 700 transfers toner images onto the recording media P1 in this nip region, the toner images being transported to this position by the intermediate transfer belt 500. The second transfer roller 700 corresponds to an example of a "roller component" and a "first roller component" according to an exemplary embodiment of the present invention. The support roller 650 corresponds to an example of a "second roller component" according to an exemplary embodiment of the present invention.

At least one of the support rollers 610, 620, 630, 640, and 650 and the second transfer roller 700 is rotated by a driving force generated by a driving device such as a motor and functions as a driving unit that rotates the intermediate transfer belt 500 in the direction shown by the arrow A2 in FIG. 1.

The fixing unit 800 includes a pair of rollers facing each other. The fixing unit 800 heats and pressurizes the transported recording media P1 at this facing position to fix the transferred toner images to the recording media P1. With the functions of the respective components described above, the image forming apparatus 10 forms an image on the recording media P1.

Figure 2:
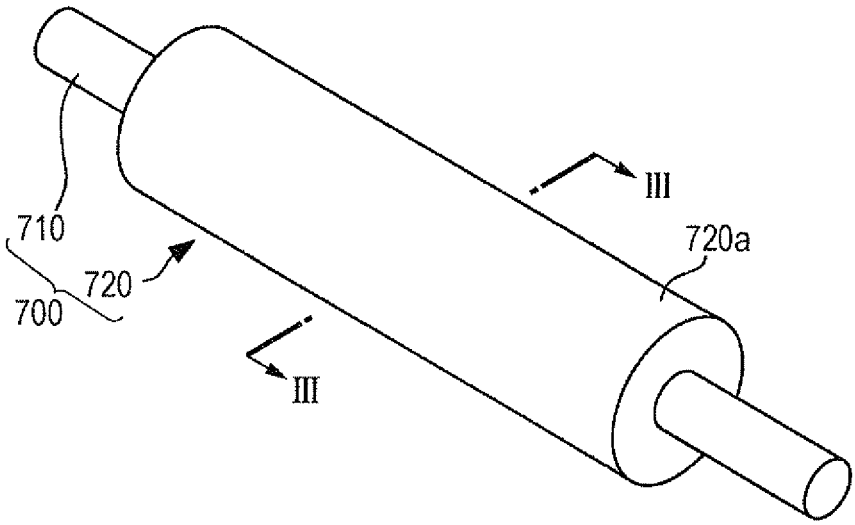
FIG. 2 is a perspective view of a second transfer roller.

FIG. 2 is a perspective view of the second transfer roller 700. The second transfer roller 700 is a roller including a shaft 710 and a contact layer 720. The shaft 710 is a component that is rotatably supported by a shaft bearing provided in the image forming apparatus 10 and that functions as a rotation axis of the second transfer roller 700. The shaft 710 is a component containing iron plated with, for example, chromium; an alloy such as stainless steel; aluminum or the like. In this exemplary embodiment, the shaft 710 is a component containing stainless steel. The shaft 710 functions as an electrode for applying a second transfer bias voltage. In addition, the above-described support roller 650 includes an electrode for applying the second transfer bias voltage. The second transfer bias voltage is applied between the second transfer roller 700 and the support roller 650 through this electrode and the shaft 710. The contact layer 720 is a cylindrical or substantially cylindrical layer that is provided on the surface of the shaft 710, that faces the support roller 650 with the intermediate transfer belt 500 therebetween, and that rotates around the shaft 710 while being in contact with the intermediate transfer belt 500. When the recording media P1 is transported to the above-mentioned nip region, the contact layer 720 contacts the recording media P1. When the second transfer bias voltage is applied between the second transfer roller 700 and the support roller 650 in the state in which the contact layer 720 is in contact with the recording media P1, an electric field is generated between the second transfer roller 700 and the support roller 650, and toner images are secondarily transferred from the intermediate transfer belt 500 to the recording media P1 by this electric field.

Figure 3:
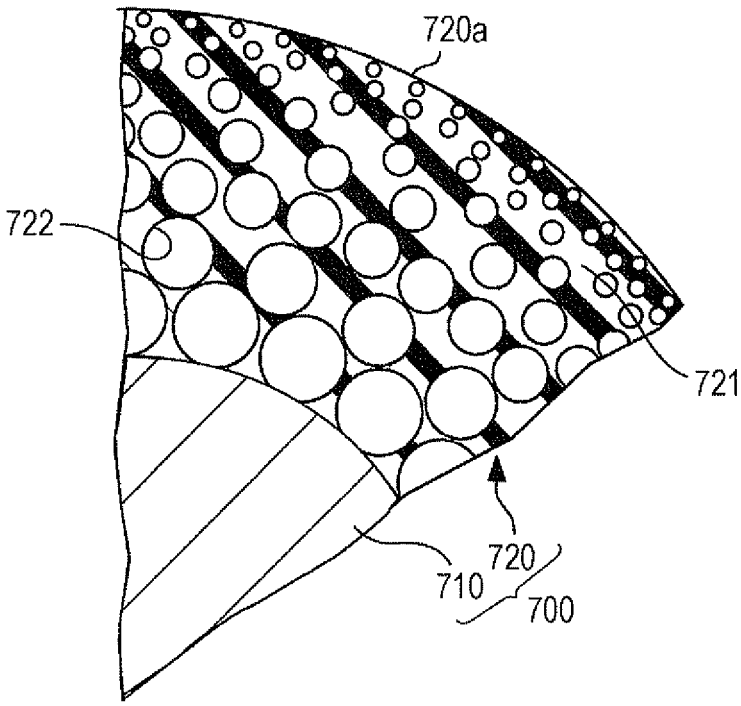
FIG. 3 is a cross-sectional view of the second transfer roller.

FIG. 3 is a cross-sectional view of the second transfer roller 700 taken along line III-III in FIG. 2. Even though a portion of a cross section of the second transfer roller 700 is shown in FIG. 3 for the sake of convenience of explanation, the remaining portion of the second transfer roller 700 also has the same structure as that of the portion shown in FIG. 3. The contact layer 720 is a layer composed of a foamed rubber material 721 including plural cells 722 formed by gas, the layer being formed into a cylindrical body or a substantially cylindrical body, in which the volume of the cells 722 decreases from the inner side of the cylindrical or substantially cylindrical body toward the outside. Furthermore, in the contact layer 720, the ratio of the volume of the cells 722 to the volume of the rubber material 721 per unit volume decreases from the inner side of the cylindrical or substantially cylindrical body. That is, in the contact layer 720, the thickness of the rubber material 721 sandwiched between cells 722 increases toward the surface 720*a* side. The contact layer 720 has a density of 0.35 g/cm$^3$ or more and 0.55 g/cm$^3$ or less or about 0.35 g/cm$^3$ or more and about 0.55 g/cm$^3$ or less, and a hardness of 30° or more and 40° or less, or about 30° or more and about 40° or less measured with an Asker-C hardness meter. When the thickness of the rubber material 721 is divided into three portions, and the density of an outermost portion is represented by A, the density of an intermediate portion is represented by B, and the density of an innermost portion is represented by C, the relationship A>B>C is satisfied, the difference between A and B is larger than 0.15 g/cm$^3$ or about 0.15 g/cm$^3$, and the difference between B and C is larger than 0.15 g/cm$^3$ or about 0.15 g/cm$^3$.

Figure 4:
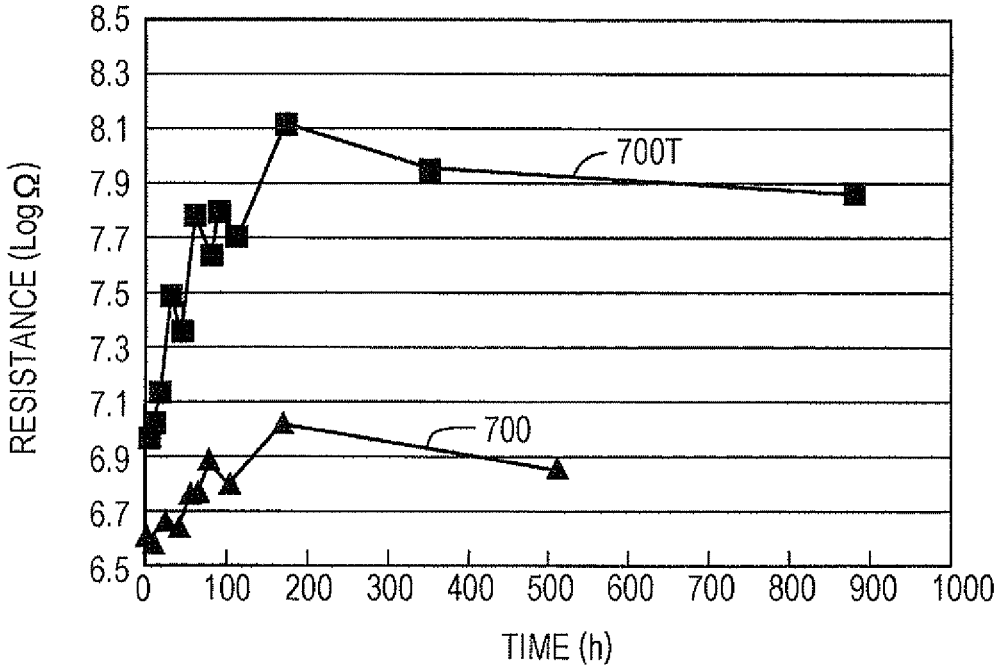
FIG. 4 is a graph showing measurement results of a volume resistance of contact layers of second transfer rollers.

FIG. 4 is a graph showing measurement results of the volume resistance of contact layers of second transfer rollers with which transfer is repeatedly performed. In this measurement, the second transfer roller 700 and a second transfer roller 700T for a comparative example are used. The second transfer roller 700T includes a contact layer in which the volume of the cells 722 and the ratio of the volume of the cells 722 to the volume of the rubber material 721 per unit volume do not decrease from the inner side of the cylindrical or substantially cylindrical body toward the outside. In this measurement, an image is formed on 50,000 sheets of recording media using the image forming apparatus 10 of this exemplary embodiment and an image forming apparatus in which the second transfer roller 700 of the image forming apparatus 10 is replaced with the second transfer roller 700T, and the volume resistance of the respective contact layers is measured. The vertical axis of FIG. 4 represents the common logarithm of the volume resistance (in units of log Ω), and the horizontal axis of FIG. 4 represents the time (in units of h). In this measurement, the image forming apparatuses are operated in the environment at a temperature of 22° C. and at a humidity of 55%. As for the second transfer roller 700, the volume resistance before the image formation is 6.60 (log Ω), and the volume resistance after the formation of the image on 50,000 sheets of the recording media is 6.86 (log Ω). As for the second transfer roller 700T, the volume resistance before the image formation is 6.99 (log Ω), and the volume resistance after the formation of the image on 50,000 sheets of the recording media is 7.85 (log Ω). The amount of variation in the volume resistance of the contact layer 720 of the second transfer roller 700 is 0.24 (log Ω), whereas the amount of variation in the volume resistance of the contact layer of the second transfer roller 700T is 0.90 (log Ω).

Since the volume of the contact layer 720 of the second transfer roller 700 is the same as that of the second transfer roller 700T, the volume resistivities of the contact layers also show the same relationship and change with time as those shown in FIG. 4. A description will now be made of the volume resistivities shown by the measurement results of FIG. 4. The amount of increase in the volume resistivity of the second transfer roller 700 is smaller than that of the second transfer roller 700T. It is believed that, in a contact layer of a second transfer roller, the volume resistivity is increased by the following mechanism. Specifically, the rubber material is deteriorated by being oxidized with electrical discharge generated inside the cells, and as a result, electrically conductive paths are lost. In the second transfer roller 700, the volume of the cells 722 at the surface 720*a* side is smaller than that in the second transfer roller 700T, and thus discharge is not easily generated inside the cells 722. Accordingly, it is believed that the amount of increase in the volume resistivity is small in the second transfer roller 700. In addition, in the contact layer 720 of the second transfer roller 700, an electrical bond of the rubber material 721 sandwiched between cells 722 is broken by the discharge generated inside the cells 722, and as a result, a current does not easily flow. It is believed that this also increases the volume resistivity. In the second transfer roller 700, the thickness of the rubber material 721 sandwiched between cells 722 at the surface 720*a* side is larger than that in the second transfer roller 700T. Accordingly, even if the above-described breaking occurs in a certain part at the surface 720*a* side of the rubber material 721, electrical bonds tend to remain in the part. It is believed that, as a result, the amount of increase in the volume resistivity in the second transfer roller 700 is smaller than that of the second transfer roller 700T.

Figure 5:
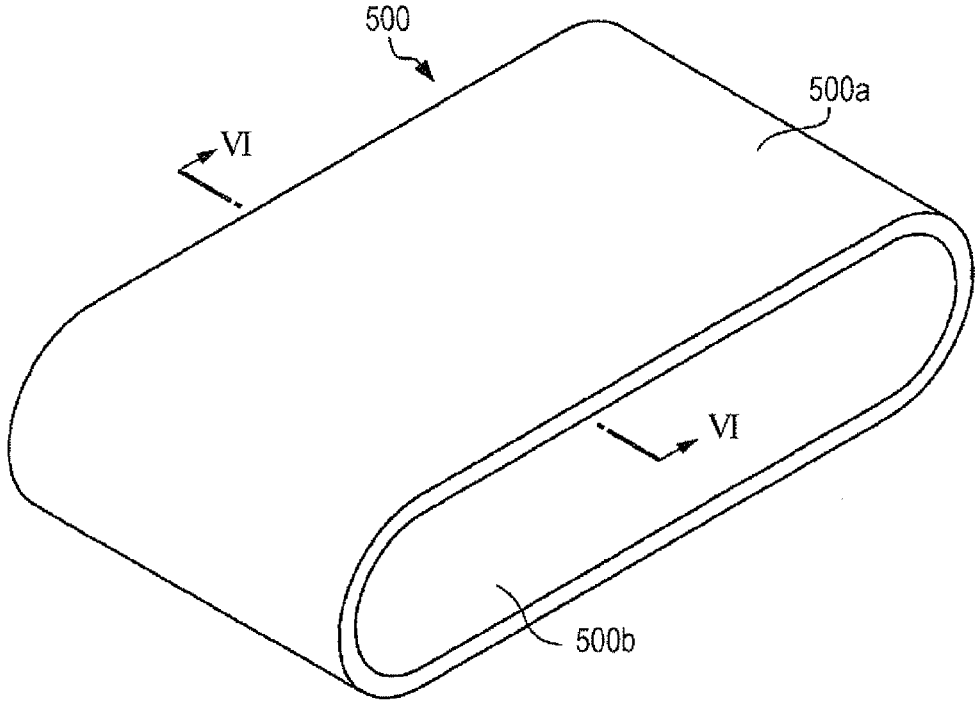
FIG. 5 is a perspective view of an intermediate transfer belt.

FIG. 5 is a perspective view of the intermediate transfer belt 500. As described above, the intermediate transfer belt 500 is a rotatable endless belt. The intermediate transfer belt 500 is supported by support rollers that are in contact with a surface 500*b* of the inner peripheral side. The intermediate transfer belt 500 attaches a toner on a surface 500*a* of the outer peripheral side and transports the toner.

Figure 6:
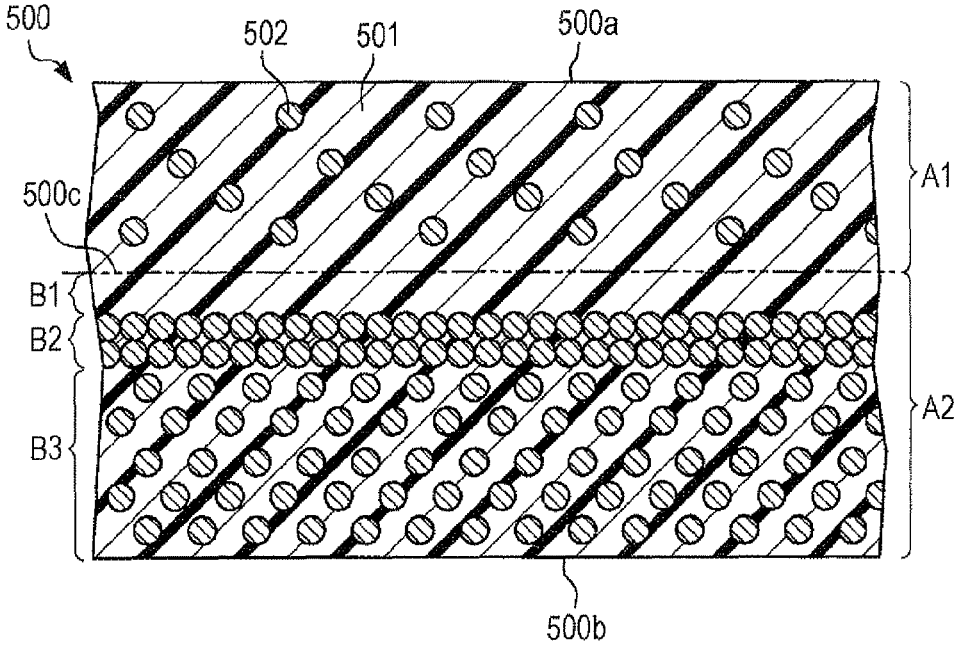
FIG. 6 is a cross-sectional view of the intermediate transfer belt.

FIG. 6 is a cross-sectional view of the intermediate transfer belt 500. FIG. 6 shows a cross section taken along line VI-VI in FIG. 5. The intermediate transfer belt 500 includes a resin 501 and an electrically conductive agent 502. The resin 501 is a polyimide resin, a polyamide-imide resin, or the like. In this exemplary embodiment, the resin 501 is a polyimide resin. The electrically conductive agent 502 is a material, such as carbon black or polyaniline, which increases the electrical conductivity of a resin when being added to the resin. In this exemplary embodiment, the electrically conductive agent 502 is carbon black.

The intermediate transfer belt 500 includes a first layer A1 and a second layer A2 that is layered on the surface 500*b* side of the first layer A1. The first layer A1 contains the resin 501 and the electrically conductive agent 502, and the second layer A2 contains the resin 501 and the electrically conductive agent 502. The content of the electrically conductive agent 502 per unit volume of the second layer A2 is higher than the content of the electrically conductive agent 502 per unit volume of the first layer A1. A boundary surface 500*c* is formed at the boundary between the first layer A1 and the second layer A2.

The second layer A2 includes a first region B1, a second region B2, and a third region B3 which are sequentially layered in the thickness direction from the boundary surface 500*c* side to the surface 500*b* side. The first region B1 is a region that does not contain the electrically conductive agent 502. Both the second region B2 and the third region B3 contain the electrically conductive agent 502. The electrical conductivity of the second region B2 is 5 times, or about 5 times the electrical conductivity of the third region B3 or more. The first region B1 and the second region B2 are layered in a range up to 15 μm or about 15 μm from the boundary surface 500*c* in the thickness direction of the second layer A2.

Figure 7A:
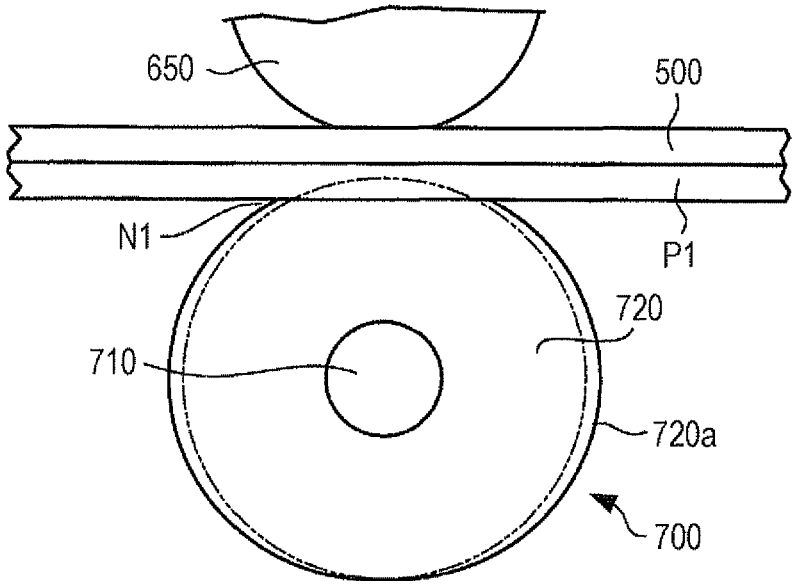
FIGS. 7A and 7B each show an example of a deformation in a nip region of a second transfer roller.
Figure 7B:
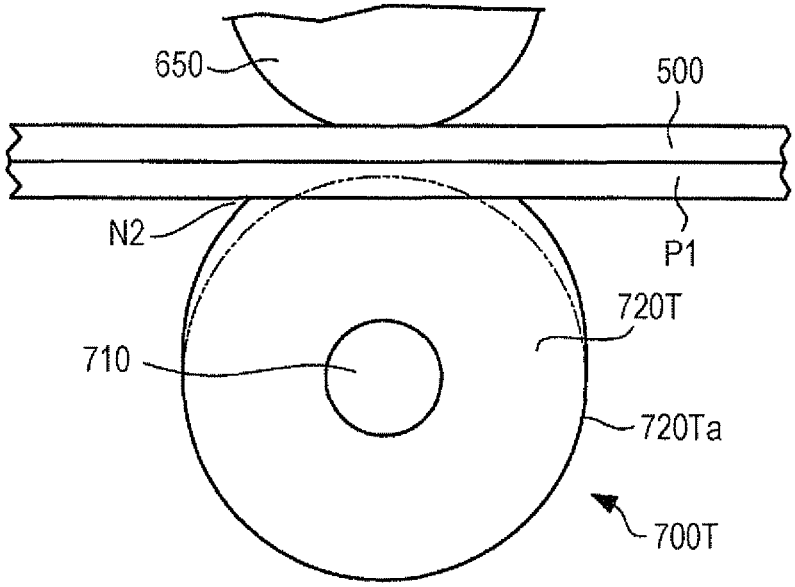

FIGS. 7A and 7B each show an example of a deformation in a nip region of the second transfer roller 700. FIG. 7A shows a state in which the intermediate transfer belt 500 and the second transfer roller 700 contact each other to form a nip region N1, and a recording media P1 is transported to the nip region N1. In the contact layer 720, since the ratio of the volume taken up by the rubber material 721 increases toward the surface 720*a*, the contact layer 720 of the surface 720*a* side is harder than the contact layer 720 of the rotation axis side. Accordingly, the entire contact layer 720 is deformed by a force applied to the nip region N1. A second transfer bias voltage is applied between the contact layer 720 and the support roller 650 in a state in which the contact layer 720 is deformed in this manner, and the contact layer 720 transfers a toner image onto a recording media P1 by an action of the generated electric field. FIG. 7B shows a state in which a contact layer 720T of the second transfer roller 700T shown in FIG. 4 forms a nip region N2 together with an intermediate transfer belt 500, and a recording media P1 is transported to the nip region N2. As described above, in the contact layer 720T, since the ratio of the volume of the cells 722 to the volume of the rubber material 721 per unit volume does not decrease from the inner side of the cylindrical or substantially cylindrical body toward the outside, the surface 720Ta side of the contact layer 720T is easily deformed, as compared with the contact layer 720. Accordingly, the surface 720Ta side of the contact layer 720T is significantly deformed by a force applied to the nip region N2, as compared with the contact layer 720. A second transfer bias voltage is applied between the contact layer 720T and the support roller 650 that faces the contact layer 720T in a state in which the contact layer 720T is deformed in this manner, and the contact layer 720T transfers a toner image onto a recording media P1 by an action of the generated electric field.

Regarding the intermediate transfer belt 500, because of a difference in characteristics between the first layer A1 and the second layer A2 due to a difference in the amount of electrically conductive agent 502 contained therein, a discharge product is accumulated on the surface 500*b* as the intermediate transfer belt 500 is used. When such a discharge product is accumulated, electrical discharge is generated between the second transfer roller 700 and the intermediate transfer belt 500, and defects such as print defects of the image density may be generated on a formed image by the influence of the electrical discharge. In addition, it is believed that the second transfer roller 700 has a structure in which electrical discharge is not easily generated between the second transfer roller 700 and the intermediate transfer belt 500 in the nip region N1, as compared with the second transfer roller 700T. Therefore, in the image forming apparatus including the second transfer roller 700, defects such as print defects of the image density are not easily generated on an image formed on the recording media P1, as compared with the image forming apparatus including the second transfer roller 700T.

FIG. 8 is a table showing the results when the volume resistance of a contact layer and the image quality before and after image formation are examined. In the examination shown in FIG. 8, the intermediate transfer belt 500, a single-layer intermediate transfer belt 500T, and the second transfer rollers 700 and 700T shown in FIG. 4 are used. The second transfer roller 700 has a hardness of 38° measured with an Asker-C hardness meter and includes a contact layer 720 having a density of 0.46 g/cm$^3$. The second transfer roller 700T has a hardness of 37° measured with an Asker-C hardness meter and includes a contact layer having a density of 0.48 g/cm$^3$. In FIG. 8, as for conditions of the temperature and humidity during the formation of an image, a condition at a temperature of 28° C. and a humidity of 85% is represented as a first condition, and a condition at a temperature of 10° C. and a humidity of 15% is represented as a second condition.

In the case where the intermediate transfer belt 500 and the second transfer roller 700 are used in combination, the volume resistance before image formation is 6.60 (log Ω), and the volume resistance after image formation is 6.86 (log Ω). These values of the volume resistance are measured under the condition at a temperature of 22° C. and a humidity of 55%. In this measurement, the roller is placed on a metal flat plate, and a load of 500 g is applied to each side of the shaft of the roller so that a total load of 1 kg is applied. A voltage of 1,000 V is then applied to the shaft, and the value of a current that flows on the metal flat plate is measured with a microammeter to calculate the resistance. In addition, deterioration of image quality (defect of an image) is not generated in each of the first condition before image formation, and the first and second conditions after image formation. In the case where the intermediate transfer belt 500T and the second transfer roller 700 are used in combination, the volume resistance before image formation is 6.60 (log Ω), and the volume resistance after image formation is 6.84 (log Ω).

The image quality is evaluated as follows. A print test is performed with a DocuCentreColor 2220 (modified device) produced by Fuji Xerox Co., Ltd. (process speed: 500 mm/sec, first transfer current: 45 RA, second transfer voltage: 3.5 kV) in the environment at a temperature of 28° C. and a humidity of 80%. In the test, a comprehensive pattern including characters and patches is printed out using A4 size-C2 paper produced by Fuji Xerox Co., Ltd. until the total printing time becomes 500 hours.

Under the first condition before and after image formation, deterioration of the image quality does not occur. However, under the second condition after image formation, deterioration of the image quality (slight generation of scale-like pattern) occurs. In the case where the intermediate transfer belt 500T and the second transfer roller 700T are used in combination, the volume resistance before image formation is 6.99 (log Ω), and the volume resistance after image formation is 7.85 (log Ω). Under the first condition before image formation and the second condition after image formation, deterioration of the image quality does not occur. However, under the first condition after image formation, deterioration of the image quality (generation of white lines) occurs. It should be noted that, as described above, even when the volume resistivity is measured instead of the volume resistance, the same relationship of the measurement results of the second transfer rollers 700 and 700T and the examination results thereof as those shown in FIG. 8 are obtained.

The second transfer roller 700 is prepared as follows. First, 30 parts by mass of acrylonitrile-butadiene rubber (NBR: Nipol DN-219 produced by Zeon Corporation) is mixed with 60 parts by mass of epichlorohydrin rubber (ECO: Epichlomer CG-102 produced by Daiso Co., Ltd.) having an ethylene oxide group that functions to conduct ions. Next, 1 part by mass of sulfur (200 mesh, produced by Tsurumi Chemical Industries Co., Ltd.), 1.5 parts by mass of a vulcanization accelerator (Nocceler M, produce by Ouchi Shinko Chemical Industrial Co., Ltd.), 28 parts by mass of carbon black (Special black 250, produced by Degussa AG) functioning as an electron-conducting agent, and 6 parts by mass of benzenesulfonylhydrazide functioning as a foaming agent are added to the mixture. The mixture is kneaded with an open roll mill. The kneaded mixture is wound around a roller shaft (stainless steel: SUS) having a diameter ϕ of 10 mm. This mixture is heated to 160° C. using the roller shaft as a heat source, and vulcanization and foaming are performed while blowing air on the surface layer side so as to accelerate the foaming in the inside. Thus, a roller in which the foaming in the outside is suppresses is prepared. The outer peripheral surface of this roller is polished to obtain a second transfer roller 700 having a diameter of 18.8 mm.

The intermediate transfer belt 500 is prepared as follows. To a N-methylpyrrolidone (NMP) solution (solid content after imidization being 18% by mass) of a polyamic acid, the solution containing 3,3',4,4'-biphenyltetracarboxylic acid dianhydride and 4,4'-diaminodiphenyl ether, carbon black (Special Black 4, produced by Degussa AG) is added in an amount of 80 parts by mass relative to 100 parts by mass of the solid content of the polyamic acid. The resultant solution is passed through a dispersing unit five times at a pressure of 200 MPa using a jet-mill dispersing machine (Geanus PY, [minimum cross-sectional area of collision portion: 0.032 $mm^2$] produced by Geanus Corporation) to perform dispersion and mixing. Thus, a dispersion liquid is obtained. The NMP solution is added to the dispersion liquid so that 22 parts by mass of carbon black is contained in 100 parts by mass of the polyamic acid. The solution is mixed and stirred using a planetary mixer (Aicoh Mixer, manufactured by Aicohsha Manufacturing Co., Ltd.). Thus, a carbon-black-dispersed polyimide precursor solution (hereinafter referred to as "first solution") is prepared.

Next, a carbon-black-dispersed polyimide precursor solution (hereinafter referred to as "second solution") is prepared by the same method as that described as a method for preparing the first solution except that the NMP solution is added to the dispersion liquid so that 16 parts by mass of carbon black is contained in 100 parts by mass of the polyamic acid.

A metal mold for fabricating the intermediate transfer belt 500 is prepared by applying a silicone mold release agent (trade name: KS700, produced by Shin-Etsu Chemical Co., Ltd.) onto a surface of an aluminum cylindrical component having an outer diameter of 302 mm, a length of 500 mm, and a wall thickness of 10 mm, and then baking the aluminum cylindrical component at 300° C. for one hour. The first solution is applied onto this aluminum cylindrical component by flow coating. The cylindrical component is dried by heating at 120° C. for 25 minutes while keeping the horizontal state and rotating at 6 rpm, thus obtaining a carbon-black-dispersed polyimide precursor dry film (hereinafter referred to as "third region film") functioning as the third region B3. The third region film has a thickness of 40 μm. In this drying, the first solution is dried so that a ratio of the weight of the remaining solvent to the weight of the solvent applied as the third region film is preferably 25% or less, more preferably 20% or less, and still more preferably 15% or less. The weight of the remaining solvent is determined as follows. For example, in the case where the weight of the solid content of the resin material (dry weight of the resin material) and the weight of the electrically conductive agent are known as the amounts of solid content, the total weight of the coating film before drying is accurately weighed to calculate the weight of the solvent contained in the total weight of the coating film. Subsequently, the total weight of the coating film after drying is accurately weighed, and the amount of decrease is determined as the weight of the lost solvent. The ratio of the weight of the remaining solvent to the weight of the applied solvent is determined by calculating the value (the weight of the coating film before drying−the weight of the coating film after drying)/(the weight of coating before drying−the weight of the solid content of the resin−the weight of the electrically conductive agent).

Next, the second solution is applied onto the surface of the dry third region film. In a region where the second solution is applied, the second solution permeates through the dry third region film, and as a result, a region located under the coating surface of the third region film is in a swollen state. At this time, the amount of solvent of the second solution present on this coating surface is larger, that is, the concentration of the solvent of the second solution present on this coating surface is higher than that in the region located under the coating surface of the third region film. As a result, the resin material becomes easily eluted to the side of the second solution present on the coating surface of the third region film. Even in this case, the electrically conductive agent is not eluted in the second solution. Therefore, when the resin material is eluted, the amount of electrically conductive agent in the region from which the resin material is eluted becomes larger than that in other regions, in accordance with the amount of eluted resin material. As a result, a film (hereinafter referred to as "second region film") in which the electrically conductive agent is unevenly distributed, the film functioning as the second region B2, is formed.

Next, the second solution applied onto the third region film is dried. In this drying, the second solution is preferably dried so that a ratio of the weight of the remaining solvent to the weight of the solvent before drying is 10% or less. This weight of the remaining solvent is determined on the basis of the type of resin material used, the application, the strength, and the maintainability of the intermediate transfer belt 500, and the like. By drying the second solution, the resin material is precipitated from the second region film, and the precipitated resin material forms a film on the second region film. At this time, since the applied second solution contains the electrically conductive agent in an amount smaller than that in other regions, a film (hereinafter referred to as "first region film") that does not contain the electrically conductive agent and that functions as the first region B1, is formed on the second region film.

In the dry second solution, a part except for the part that forms the first region film forms a carbon-black-dispersed polyimide coating film functioning as the first layer A1. The polyimide coating film has a thickness of 60 μm. As a result, the boundary surface 500*c* is formed at the boundary between the first layer A1 and the first region B1.

The single-layer intermediate transfer belt 500T shown in FIG. 7B is fabricated as follows. A process common to the process for forming the second layer A2 is performed using the above-described first solution. An aluminum cylindrical component is prepared by applying a silicone mold release agent (trade name: KS700, produced by Shin-Etsu Chemical Co., Ltd.) onto a surface of an aluminum cylindrical component having an outer diameter of 302 mm, a length of 500 mm, and a wall thickness of 10 mm, and then baking the aluminum cylindrical component at 300° C. for one hour. The first solution is applied onto this aluminum cylindrical component by flow coating. The cylindrical component is dried by heating at 150° C. for 25 minutes while keeping the horizontal state and rotating at 6 rpm. Thus, a carbon-black-dispersed polyimide precursor dry film is obtained. The cylindrical component having the film thereon is heated at 200° C. for 30 minutes, at 260° C. for 30 minutes, at 300° C. for 30 minutes, and at 320° C. for 20 minutes to form a carbon-black-dispersed polyimide coating film. The carbon-black-dispersed polyimide film has a thickness of 85 μm.

Modifications

The exemplary embodiment described above is merely an example of an implementation of the present invention. The present invention may be implemented in accordance with exemplary embodiments in which the following modifications are applied to the above-described exemplary embodiment. It should be noted that the modifications described below may be implemented in appropriate combination if necessary.

First Modification

The roller component according to an exemplary embodiment of the present invention may be applied to a component other than the second transfer roller. For example, the roller component according to an exemplary embodiment of the present invention may be used in the first transfer roller 310, 320, 330, or 340. In such a case, an intermediate transfer belt in which regions and a layer corresponding to the third region B3, the second region B2, the first region B1, and the first layer A1 are sequentially formed from the outer peripheral side to the inner peripheral side may be used. Alternatively, the roller component according to an exemplary embodiment of the present invention may be used as the support roller 650 in which a second transfer bias voltage is applied between the second transfer roller 700 and the support roller 650. Thus, the roller component according to an exemplary embodiment of the present invention may be used as a roller component for transfer in a so-called direct-transfer-type image forming apparatus, which does not include an intermediate transfer belt.

Second Modification

According to the above-described exemplary embodiment, in the second transfer roller 700, the ratio of the volume of the cells 722 to the volume of the rubber material 721 per unit volume decreases from the inner side of the cylindrical or substantially cylindrical body toward the outside. In the roller component according to an exemplary embodiment of the present invention, this ratio may not decrease so long as the volume of the cells 722 decreases. Also in this case, the change in the volume resistivity with time is reduced.

Figure 9:
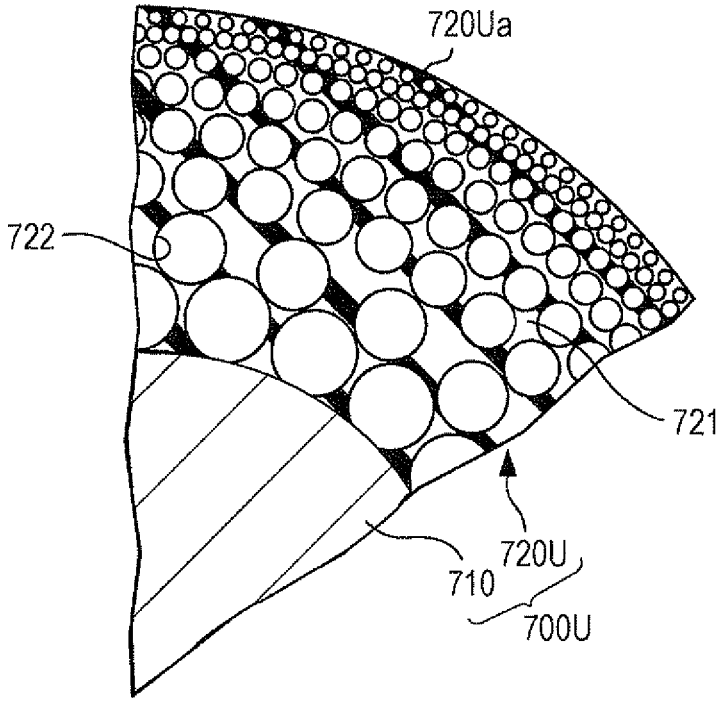
FIG. 9 is a cross-sectional view of a second transfer roller according to a modification.

FIG. 9 is a cross-sectional view of a second transfer roller 700U according to this modification. Even though a portion of a cross section of the second transfer roller 700U is shown in FIG. 9, the remaining portion of the second transfer roller 700U also has the same structure as that of the portion shown in FIG. 9. A contact layer 720U is a layer composed of a foamed rubber material 721 including plural cells 722 formed by gas, the layer being formed into a cylindrical body or a substantially cylindrical body, in which the volume of the cells 722 decreases from the inner side of the cylindrical or substantially cylindrical body toward the outside. In the second transfer roller 700U, the volume of the cells 722 at the surface 720Ua side is smaller than that in the second transfer roller 700T described above, and thus discharge does not easily occur inside the cells 722.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A roller component comprising:

a layer composed of a foamed rubber material including a plurality of cells formed by gas, the layer being formed into a substantially cylindrical body, wherein a volume of the cells decreases from an inner side of the substantially cylindrical body toward an outside.

2. The roller component according to claim 1, wherein a ratio of the volume of the cells to a volume of the foamed rubber material per unit volume decreases from the inner side of the substantially cylindrical body toward the outside.

3. The roller component according to claim 2, wherein when a thickness of the layer is divided into three portions, and a density of an outermost portion is represented by A, a density of an intermediate portion is represented by B, and a density of an innermost portion is represented by C, a relationship A>B>C is satisfied, a difference between A and B is larger than about 0.15 g/cm$^3$, and a difference between B and C is larger than about 0.15 g/cm$^3$.

4. The roller component according to claim 1, wherein the layer has a density of about 0.35 g/cm$^3$ or more and about 0.55 g/cm$^3$ or less, and a hardness of about 30° or more and about 40° or less measured with an Asker-C hardness meter.

5. An image forming apparatus comprising:

a first roller component formed of the roller component according to claim 1;

a second roller component; and a transfer belt onto which a toner is transferred, wherein the first roller component includes a shaft as a first electrode for applying a transfer bias voltage, and faces the second roller component with the transfer belt therebetween, the layer rotates around the shaft while contacting the transfer belt, and the second roller component includes a second electrode for applying the transfer bias voltage.

6. The image forming apparatus according to claim 5, wherein a ratio of the volume of the cells to a volume of the foamed rubber material per unit volume decreases from the inner side of the substantially cylindrical body toward the outside.

7. The image forming apparatus according to claim 5, wherein the layer has a density of about 0.35 g/cm$^3$ or more and about 0.55 g/cm$^3$ or less, and a hardness of about 30° or more and about 40° or less measured with an Asker-C hardness meter.

8. The image forming apparatus according to claim 7, wherein when a thickness of the layer is divided into three portions, and a density of an outermost portion is represented by A, a density of an intermediate portion is represented by B, and a density of an innermost portion is represented by C, a relationship A>B>C is satisfied, a difference between A and B is larger than about 0.15 g/cm$^3$, and a difference between B and C is larger than about 0.15 g/cm$^3$.

9. The image forming apparatus according to claim 5, wherein the transfer belt includes a first layer and a second layer, the first layer containing a resin and an electrically conductive agent, and the second layer being disposed on an inner peripheral side of the transfer belt with respect to the first layer and containing the resin and the electrically conductive agent, and a content of the electrically conductive agent in the second layer is higher than a content of the electrically conductive agent in the first layer.

10. The image forming apparatus according to claim 9, wherein the second layer includes a first region, a second region, and a third region that are sequentially layered on a boundary surface between the first layer and the second layer in a thickness direction of a second layer side, the first region and the second region are layered in a range up to about 15 μm from the boundary surface in a thickness direction of the second layer, the first region does not contain the electrically conductive agent, and an electrical conductivity of the second region is about 5 times an electrical conductivity of the third region or more.

* * * * *